US011028587B2

(12) United States Patent
Nishino et al.

(10) Patent No.: US 11,028,587 B2
(45) Date of Patent: Jun. 8, 2021

(54) CONCRETE STRUCTURE BODY AND MANUFACTURING METHOD THEREOF

(71) Applicant: SUMITOMO ELECTRIC INDUSTRIES, LTD., Osaka (JP)

(72) Inventors: Motonobu Nishino, Osaka (JP); Masato Yamada, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/631,123

(22) PCT Filed: Apr. 19, 2018

(86) PCT No.: PCT/JP2018/016122
§ 371 (c)(1),
(2) Date: Jan. 14, 2020

(87) PCT Pub. No.: WO2019/038989
PCT Pub. Date: Feb. 28, 2019

(65) Prior Publication Data

US 2020/0157817 A1 May 21, 2020

(30) Foreign Application Priority Data

Aug. 25, 2017 (JP) ..... JP2017-162023

(51) Int. Cl.
*E04C 5/08* (2006.01)
*E04C 5/12* (2006.01)
(Continued)

(52) U.S. Cl.
CPC ..... *E04C 5/08* (2013.01); *E01D 19/125* (2013.01); *E04B 1/046* (2013.01); *E04B 5/023* (2013.01);
(Continued)

(58) Field of Classification Search
CPC ... E04C 5/08; E04C 5/085; E04C 5/12; E04C 5/122; E04C 5/125; E04C 5/161;
(Continued)

(56) References Cited

U.S. PATENT DOCUMENTS 4,413,454 A * 11/1983 Milh ..... E04B 1/04 52/236.6
4,671,034 A * 6/1987 Rehm ..... E04C 5/12 52/223.13
(Continued)

FOREIGN PATENT DOCUMENTS

CN 201952969 U 8/2011
CN 103821264 A * 5/2014 ..... E04B 1/046
(Continued)

*Primary Examiner* — Ryan D Kwiecinski
(74) *Attorney, Agent, or Firm* — Oliff PLC

(57) ABSTRACT

A concrete structure body includes a first concrete member having a first facing surface; a second concrete member having a second facing surface and disposed such that the first facing surface and the second facing surface face each other; a connection portion that fills a gap between the first facing surface and the second facing surface; and a tendon disposed in the connection portion to extend along the first facing surface and the second facing surface and to which a tensile force is applied in a longitudinal direction.

13 Claims, 9 Drawing Sheets

(51) Int. Cl.

| | |
|---|---|
| ***E01D 19/12*** | (2006.01) |
| ***E04B 5/02*** | (2006.01) |
| ***E04B 1/04*** | (2006.01) |
| *E01D 101/26* | (2006.01) |

(52) U.S. Cl.
CPC ..... *E04C 5/122* (2013.01); *E04C 5/125* (2013.01); *E01D 2101/26* (2013.01)

(58) Field of Classification Search
CPC ..... E01D 19/125; E01D 2101/26; E01D 2101/28; E01D 2101/285; E01D 2101/32; E04G 21/12; E04B 5/023; E04B 5/06; E04B 1/046; E04B 1/043
See application file for complete search history.

(56) References Cited

U.S. PATENT DOCUMENTS

| | | | | | |
|---|---|---|---|---|---|
| 4,726,163 | A * | 2/1988 | Jacobs | B28B 23/043 | 264/228 |
| 7,841,061 | B1 * | 11/2010 | Sorkin | E04C 5/122 | 29/452 |
| 9,797,138 | B2 * | 10/2017 | Sanabra | E04B 5/48 | |
| 9,982,434 | B1 * | 5/2018 | Crigler | E04C 5/122 | |
| 10,738,422 | B2 * | 8/2020 | Annan | E04H 15/16 | |
| 2015/0300988 | A1 * | 10/2015 | Park | G01M 5/0025 | 324/209 |
| 2018/0274237 | A1 * | 9/2018 | Oikawa | D07B 1/145 | |
| 2019/0203458 | A1 * | 7/2019 | Rutledge | E04B 1/19 | |
| 2020/0157817 | A1 * | 5/2020 | Nishino | E04B 5/023 | |

FOREIGN PATENT DOCUMENTS

| | | | | | |
|---|---|---|---|---|---|
| CN | 104264786 | A | * | 1/2015 | |
| CN | 108166391 | A | * | 6/2018 | |
| CN | 207919369 | U | * | 9/2018 | |
| DE | 202009000707 | U1 | * | 4/2009 | B28B 7/0029 |
| DE | 102008013206 | A1 | * | 9/2009 | E04G 21/126 |
| FR | 2682141 | A1 | * | 4/1993 | E21D 11/083 |
| FR | 2687711 | A1 | * | 8/1993 | E04H 7/18 |
| FR | 2850409 | A1 | * | 7/2004 | E01D 19/125 |
| FR | 2986545 | A1 | * | 8/2013 | B21F 27/12 |
| JP | 2003-027415 | A | | 1/2003 | |
| JP | 2012-062664 | A | | 3/2012 | |
| JP | 2013-133598 | A | | 7/2013 | |
| JP | 2015-137473 | A | | 7/2015 | |
| KR | 20110029489 | A | * | 3/2011 | |
| KR | 20150051706 | A | * | 5/2015 | |
| WO | WO-2008135849 | A1 | * | 11/2008 | E04B 1/34823 |

* cited by examiner

CONCRETE STRUCTURE BODY AND MANUFACTURING METHOD THEREOF

TECHNICAL FIELD

The present invention relates to a concrete structure body and a manufacturing method thereof. The present application claims priority based on Japanese Application No. 2017-162023, filed Aug. 25, 2017, the entire contents of which are incorporated herein by reference.

BACKGROUND ART

A precast concrete (Precast Concrete; PC) floor slab, which is a concrete member, is usable in, for example, construction of a floor slab of a bridge. Specifically, as a method of constructing a floor slab of a bridge, which is a concrete structure body, there is a known method in which, after a plurality of PC floor slabs are disposed adjacent to each other on a steel girder, the adjacent PC floor slabs are connected together with gaps therebetween filled with concrete (for example, refer to PTL 1).

CITATION LIST

Patent Literature

PTL 1: Japanese Unexamined Patent Application Publication No. 2012-62664

SUMMARY OF INVENTION

A concrete structure body according to the present invention includes: a first concrete member having a first facing surface; a second concrete member having a second facing surface and disposed such that the first facing surface and the second facing surface face each other; a connection portion that fills a gap between the first facing surface and the second facing surface; and a tendon disposed in the connection portion to extend along the first facing surface and the second facing surface and to which a tensile force is applied in a longitudinal direction.

A method of manufacturing a concrete structure body according to the present invention includes: a step of disposing a first concrete member having a first facing surface and a second concrete member having a second facing surface such that the first facing surface and the second facing surface face each other; a step of disposing a tendon so as to extend along the first facing surface and the second facing surface and, while holding the tendon with a holding member disposed to straddle on an external wall of the first concrete member and on an external wall of the second concrete member, applying a tensile force to the tendon in a longitudinal direction thereof; a step of filling a gap between the first facing surface and the second facing surface with a filling material that solidifies with a lapse of time; and a step of removing the holding member that holds the tendon extending in the filling material that has solidified.

DESCRIPTION OF EMBODIMENTS

Figure 1:
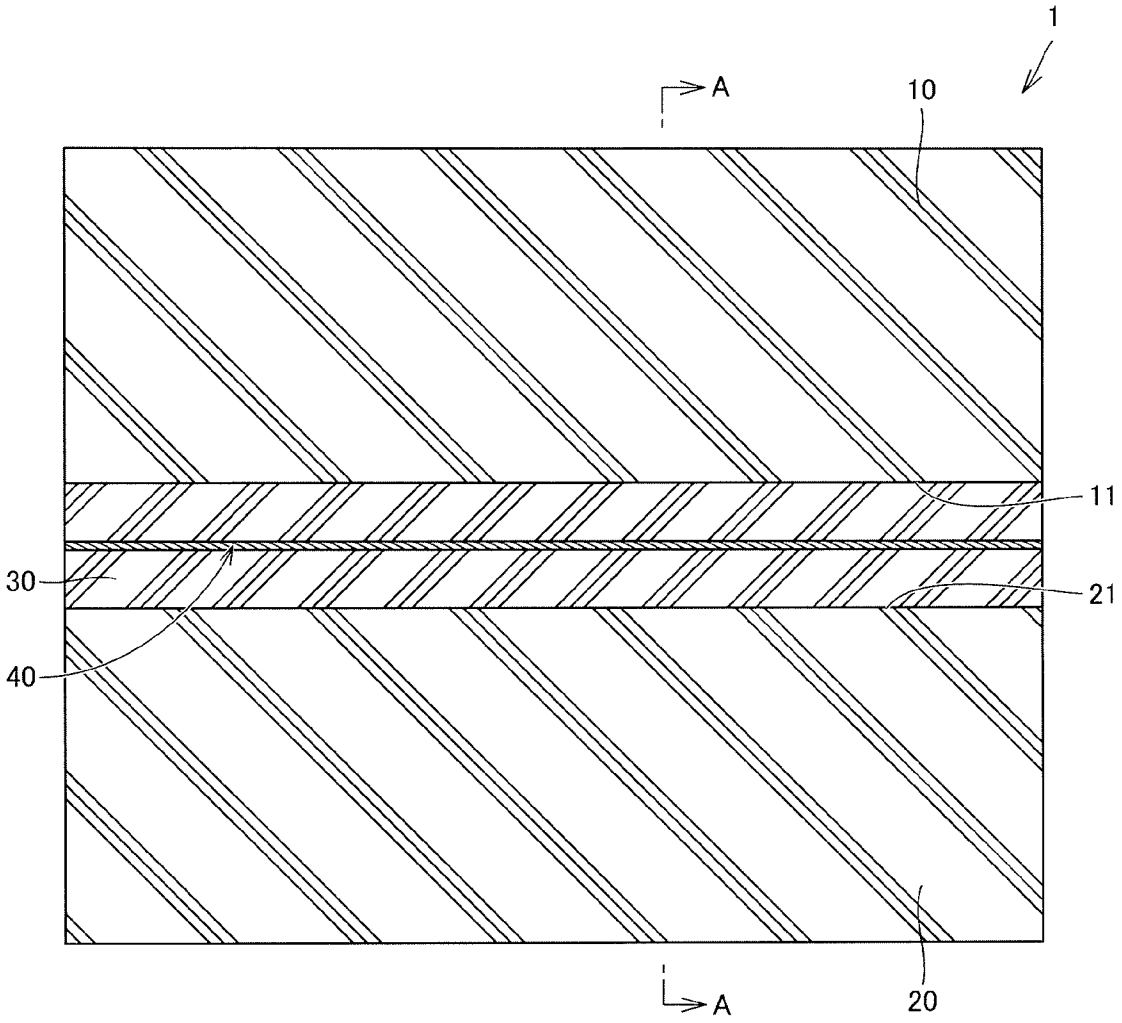
FIG. 1 is a schematic sectional view illustrating a structure of a floor-slab structure body according to a first embodiment.

Problems to be Solved By Present Disclosure

In a floor slab (concrete structure body) of a bridge constructed by the aforementioned method, a connection portion that is formed as a result of solidification of concrete that fills gaps between adjacent PC floor slabs is inferior to the PC floor slabs in durability. Therefore, there is a problem that, even when PC floor slabs excellent in durability are employed, durability as the whole concrete structure body is not sufficiently improved due to the presence of the connection portion inferior in durability.

One object is to provide a concrete structure body improved in durability as a whole by improving durability of a connection portion.

Advantageous Effects of Present Disclosure

According to the concrete structure body and the method of manufacturing the concrete structure body mentioned above, it is possible to provide a concrete structure body improved in durability as a whole by improving durability of a connection portion.

DESCRIPTION OF EMBODIMENTS OF PRESENT INVENTION

First, embodiments of the present invention will be listed and described. A concrete structure body according to the present application includes: a first concrete member having a first facing surface; a second concrete member having a second facing surface and disposed such that the first facing surface and the second facing surface face each other; a connection portion that fills a gap between the first facing surface and the second facing surface; and a tendon disposed in the connection portion to extend along the first facing surface and the second facing surface and to which a tensile force is applied in a longitudinal direction.

In the concrete structure body according to the present application, the tendon to which the tensile force is applied in the longitudinal direction is disposed in the connection portion to extend along the first facing surface and the second facing surface. Consequently, a compressive stress is applied to the connection portion. As a result, generation and propagation of cracks in the connection portion are suppressed, which improves durability of the connection portion. In addition, the improvement in the durability of the connection portion improves durability as the whole concrete structure body. Thus, according to the concrete structure body of the present application, it is possible to provide a concrete structure body improved in durability as a whole by improving durability of a connection portion.

In the aforementioned concrete structure body, the tendon may be a tendon that compresses the connection portion with an adhesion force with respect to the connection portion. Employing a structure in which the tendon is thus in direct contact with the connection portion and applies a compressive force thereto simplifies the structure of the concrete structure body according to the present application.

In the aforementioned concrete structure body, the tendon may include a twisted wire portion having a structure constituted by a plurality of steel wires that are twisted together, the twisted wire portion extending in the connection portion along the first facing surface and the second facing surface. The tendon that includes the twisted wire portion is suitable as a tendon of the concrete structure body according to the present application.

In the aforementioned concrete structure body, the tendon may include a cover layer that covers the outer circumference of the tendon. As a result of this, corrosion of the tendon due to, for example, infiltration of water is suppressed. The cover layer is preferably disposed to cover the outer circumference of the aforementioned twisted wire portion.

The aforementioned concrete structure body may include a plurality of tendons. Employing a plurality of tendons facilitates stable application of a compressive stress to the connection portion.

In the aforementioned concrete structure body, the connection portion may be made of concrete or mortar. Concrete and mortar are suitable as a material that constitutes the connection portion.

A method of manufacturing a concrete structure body according to the present application includes: a step of disposing a first concrete member having a first facing surface and a second concrete member having a second facing surface such that the first facing surface and the second facing surface face each other; a step of disposing a tendon so as to extend along the first facing surface and the second facing surface and, while holding the tendon with a holding member disposed to straddle on an external wall of the first concrete member and on an external wall of the second concrete member, applying a tensile force to the tendon in a longitudinal direction thereof; a step of filling a gap between the first facing surface and the second facing surface with a filling material that solidifies with a lapse of time; and a step of removing the holding member that holds the tendon extending in the filling material that has solidified.

In the method of manufacturing the concrete structure body according to the present application, the tendon to which a tensile force is applied in the longitudinal direction is disposed in the filling material that has solidified. Consequently, a compressive stress is applied to the connection portion that is obtained as a result of solidification of the filling material. As a result, generation and propagation of cracks in the connection portion are suppressed, which improves durability of the connection portion. In addition, the improvement in the durability of the connection portion improves durability as the whole concrete structure body. Thus, according to the method of manufacturing the concrete structure body of the present application, it is possible to manufacture a concrete structure body improved in durability as a whole by improving durability of a connection portion.

In the aforementioned method of manufacturing the concrete structure body, the step of filling the gap between the first facing surface and the second facing surface with the filling material may be performed after the step of applying the tensile force to the tendon in the longitudinal direction thereof. As a result of this, application of a compressive stress to the connection portion by a pre-tensioning method is achieved.

In the aforementioned method of manufacturing the concrete structure body, the tendon may include a twisted wire portion constituted by a plurality of steel wires that are twisted together. The tendon that includes the twisted wire portion is suitable as a tendon used in the method of manufacturing the concrete structure body according to the present application.

In the aforementioned method of manufacturing the concrete structure body, the tendon may include a cover layer that covers the outer circumference of the tendon. As a result of this, corrosion of the tendon due to, for example, infiltration of water is suppressed. The cover layer is preferably disposed to cover the outer circumference of the aforementioned twisted wire portion.

In the aforementioned method of manufacturing the concrete structure body, a plurality of the tendons may be disposed, and a tensile force may be applied simultaneously to the plurality of tendons in the longitudinal direction thereof in the step of applying the tensile force to the tendon in the longitudinal direction thereof. As a result of this, stable application of a compressive stress to the connection portion is facilitated.

In the aforementioned method of manufacturing the concrete structure body, the holding member may be disposed to be spaced from the filling material. As a result of this, the holding member and the filling material are suppressed from being joined together, which facilitates reuse of the holding member.

In the aforementioned method of manufacturing the concrete structure body, an intermediate member that impedes contact between the holding member and the filling material may be disposed between the holding member and the filling material. As a result of this, the holding member and the filling material are more reliably suppressed from being joined together, which further facilitates reuse of the holding member.

In the aforementioned method of manufacturing the concrete structure body, the holding member may include a wedge member that restricts the tendon, and a grip member that holds the wedge member. Employing the holding member having such a structure facilitates holding of the tendon by the holding member.

In the aforementioned method of manufacturing the concrete structure body, the filling material may be uncured concrete or uncured mortar. Uncured concrete and uncured mortar are suitable as the filling material.

Details of Embodiments of Invention of Present Application

Next, the concrete structure body and the manufacturing method thereof according to the present invention will be described below with reference to the drawings. Note that, in the following drawings, portions identical or corresponding to each other are given an identical reference number in the drawings, and description thereof will not be repeated.

First Embodiment

Figure 2:
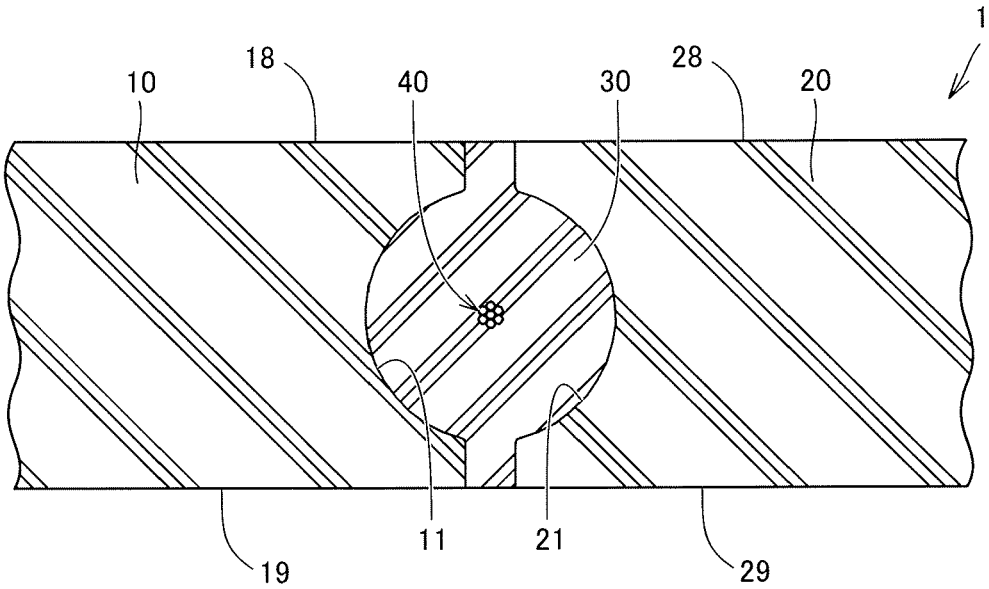
FIG. 2 is a schematic sectional view illustrating a cross section of the floor-slab structure body at a face perpendicular to the longitudinal direction of a tendon.

A floor-slab structure body, which is a concrete structure body according to a first embodiment, for an elevated road has a structure in which a plurality of PC floor slabs having the same shape are disposed adjacent to each other. Hereinafter, the floor-slab structure body according to the present embodiment will be described with reference to the drawings illustrating two adjacent PC floor slabs of the floor-slab structure body constituted by the plurality of PC floor slabs. FIG. 1 is a schematic sectional view illustrating a structure of the floor-slab structure body according to the first embodiment. FIG. 2 is a schematic sectional view illustrating a cross section of the floor-slab structure body at a face perpendicular to the longitudinal direction of the tendon. FIG. 2 is a partial sectional view along the line A-A of FIG. 1.

1. Floor-Slab Structure Body

Referring to FIG. 1 and FIG. 2, a floor-slab structure body 1 includes: a first floor slab 10, as a first concrete member (PC floor slab), having a first facing surface 11; a second floor slab 20, as a second concrete member (PC floor slab), having a second facing surface 21, the second floor slab 20 being disposed such that the first facing surface 11 and the second facing surface 21 face each other; a connection portion 30 that fills a gap between the first facing surface 11 and the second facing surface 21; and a tendon 40 disposed in the connection portion 30 to extend along the first facing surface 11 and the second facing surface 21 and to which a tensile force is applied in a longitudinal direction.

The first floor slab 10 and the second floor slab 20 having various shapes are employable. In the present embodiment, the first floor slab 10 and the second floor slab 20 each have a rectangular parallelepiped shape. The first floor slab 10 and the second floor slab 20 are PC floor slabs that are obtained as a result of concrete (uncured concrete) in a state of having fluidity solidifying after being poured into a mold that has a predetermined shape. The first floor slab 10 has a first-floor-slab first face 18 and a first-floor-slab second face 19.

The first facing surface 11 is a face that connects the first-floor-slab first face 18 and the first-floor-slab second face 19 to each other. The second floor slab 20 has a second-floor-slab first face 28 and a second-floor-slab second face 29. The second facing surface 21 is a face that connects the second-floor-slab first face 28 and the second-floor-slab second face 29 to each other.

The first floor slab 10 and the second floor slab 20 are disposed such that the first-floor-slab first face 18 and the second-floor-slab first face 28 are flush with each other. In addition, the first-floor-slab second face 19 and the second-floor-slab second face 29 are also flush with each other. The first-floor-slab first face 18 and the second-floor-slab first face 28 are faces on a travelling surface side on which vehicles travel on an elevated road. In a direction (the thickness direction of the first floor slab 10 and the second floor slab 20) perpendicular to the first-floor-slab first face 18 and the second-floor-slab first face 28, a recess is formed at a center portion of each of the first facing surface 11 and the second facing surface 21. As a result, in the thickness direction of the first floor slab 10 and the second floor slab 20, a distance between the first facing surface 11 and the second facing surface 21 is large at the center portions compared with at end portions (a region close to the first-floor-slab first face 18 and the second-floor-slab first face 28 and a region close to the first-floor-slab second face 19 and the second-floor-slab second face 29).

2. Connection Portion

The connection portion 30 is disposed to fill a space between the first floor slab 10 and the second floor slab 20. The connection portion 30 is exposed on both the side of the first-floor-slab first face 18 and the second-floor-slab first face 28 and the side of the first-floor-slab second face 19 and the second-floor-slab second face 29. The connection portion 30 is made of, for example, concrete or mortar.

3. Tendon

The tendon 40 is disposed in the connection portion 30 to extend parallel to the first facing surface 11 and the second facing surface 21. The tendon 40 is disposed in a region at the center in the thickness direction of the first floor slab 10 and the second floor slab 20 and whose distance from the first facing surface 11 and distance from the second facing surface 21 are equal to each other. The tendon 40 extends through the connection portion 30. Both end surfaces of the tendon 40 are exposed from the connection portion 30. Both end surfaces of the tendon 40 and the surface of the connection portion 30 are flush with each other.

Figure 3:
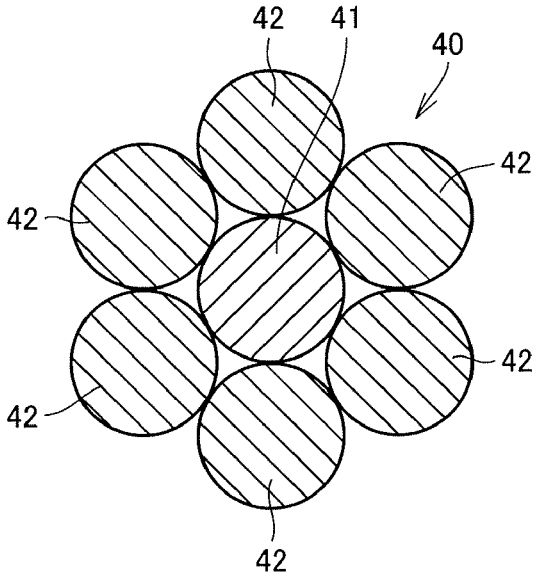
FIG. 3 is a schematic sectional view illustrating a structure of the tendon.

The tendon 40 includes a twisted wire portion having a structure constituted by a plurality of steel wires that are twisted together, the twisted wire portion extending in the connection portion 30 along the first facing surface 11 and the second facing surface 21. FIG. 3 is a cross section perpendicular to the longitudinal direction of the tendon 40. Referring to FIG. 3, the tendon 40 according to the present embodiment is constituted by a twisted wire portion. The tendon 40 includes a core wire 41 that is a steel wire and a plurality (six, here) of circumference wires 42 that are steel wires. The circumference wires 42 are disposed in contact with the outer circumferential surface of the core wire 41 to surround the outer circumferential surface of the core wire 41. The circumference wires 42 are wound in a spiral shape around the outer circumferential surface of the core wire 41. A cross section of each of the core wire 41 and the circumference wires 42 is circular.

A tensile force is applied to the tendon 40 in the longitudinal direction. In other words, a tensile stress is applied in the longitudinal direction of the tendon 40. The tendon 40 and the connection portion 30 are in contact with each other. As a result, the tendon 40 compresses the connection portion 30 with an adhesion force with respect to the connection portion 30. In a state in which the tendon 40 is held by the holding member with a tensile force being applied to the tendon 40, the connection portion 30 made of, for example, concrete or mortar is formed, and then, the holding member is removed, thereby maintaining the tensile force of the tendon 40. In other words, a compressive force is applied to the connection portion 30 by a pre-tensioning method. A specific method of manufacturing the floor-slab structure body will be described later.

4. Modification of Floor-Slab Structure Body

Figure 4:
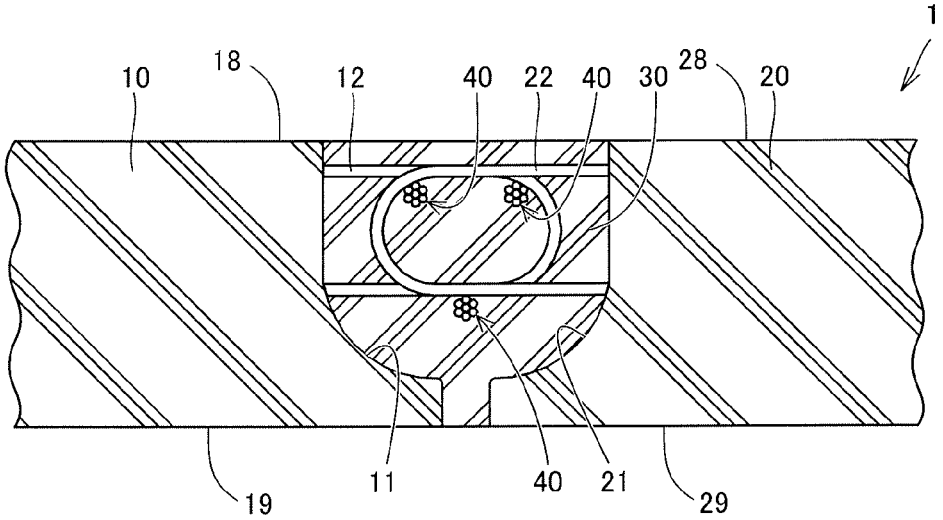
FIG. 4 is a schematic sectional view illustrating a cross section of the floor-slab structure body perpendicular to the longitudinal direction of the tendon in a modification of the first embodiment.

FIG. 4 is a schematic sectional view illustrating a cross section of the floor-slab structure body perpendicular to the longitudinal direction of the tendon in a modification of the first embodiment. Referring to FIG. 4, in the present modification, the first floor slab 10 further includes a first reinforcing steel 12. In addition, the second floor slab 20 further includes a second reinforcing steel 22. The first reinforcing steel 12 and the second reinforcing steel 22 are disposed such that portions thereof are embedded in the first floor slab 10 and the second floor slab 20, respectively, and loop portions, which are other portions thereof, project from the first facing surface 11 and the second facing surface 21, respectively. The first reinforcing steel 12 projects toward the second facing surface 21. The second reinforcing steel 22 projects toward the first facing surface 11. In the longitudinal direction of the tendon 40, the first reinforcing steel 12 and the second reinforcing steel 22 project, at positions that differ from each other, from the first facing surface 11 and the second facing surface 21, respectively. In addition, the first reinforcing steel 12 and the second reinforcing steel 22 are disposed such that, in plan view in a direction along the longitudinal direction of the tendon 40, the first reinforcing steel 12 and the second reinforcing steel 22 that respectively project from the first facing surface 11 and the second facing surface 21 overlap each other.

In the present modification, end portions of the first facing surface 11 and the second facing surface 21 on the side of the first-floor-slab second face 19 and the second-floor-slab second face 29 project. As a result, compared with on the side of the first-floor-slab second face 19 and the second-floor-slab second face 29, a distance between the first facing surface 11 and the second facing surface 21 is large on the side of the first-floor-slab first face 18 and the second-floor-slab first face 28. In a region in which the distance between the first facing surface 11 and the second facing surface 21 is large, the first reinforcing steel 12 and the second reinforcing steel 22 project from the first facing surface 11 and the second facing surface 21, respectively.

In the present modification, the floor-slab structure body 1 includes a plurality (specifically, three) of the tendons 40 in the connection portion 30. Among the three tendons 40, two tendons 40 extend through inside the loop portions of the first reinforcing steel 12 and the second reinforcing steel 22. Among the three tendons 40, one tendon 40 extends through outside the loop portions of the first reinforcing steel 12 and the second reinforcing steel 22. The tendon 40 may be disposed, as illustrated in FIG. 4, to be in contact with at least one of the first reinforcing steel 12 and the second reinforcing steel 22. Employing the plurality of tendons 40 facilitates stable application of a compressive stress to the connection portion 30.

Figure 5:
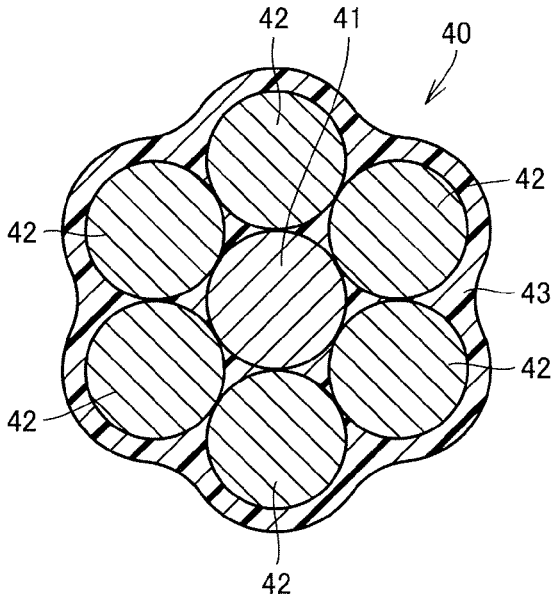
FIG. 5 is a schematic sectional view illustrating a modification of the structure of the tendon.

In addition, the tendon 40 may further include, as illustrated in FIG. 5, a cover layer 43 that covers the outer circumference of the twisted wire portion constituted by the core wire 41 and the circumference wires 42. The cover layer 43 surrounds the twisted wire portion constituted by the core wire 41 and the circumference wires 42 and fills a gap (a region between the outer circumferential surface of the core wire 41 and the outer circumferential surfaces of the circumference wires 42) of the twisted wire portion. The cover layer 43 is made of, for example, an epoxy resin. Including the cover layer 43 suppresses corrosion of the twisted wire portion due to infiltration of water and the like.

5. Effect of Floor-Slab Structure Body

In the floor-slab structure body 1, which is the concrete structure body according to the present embodiment, the tendon 40 to which a tensile force is applied in the longitudinal direction is disposed in the connection portion 30 to extend along the first facing surface 11 and the second facing surface 21. Consequently, a compressive stress is applied to the connection portion 30. As a result, generation and propagation of cracks in the connection portion 30 are suppressed, which improves durability of the connection portion 30. In addition, the improvement in the durability of the connection portion 30 improves durability as the whole floor-slab structure body 1. As stated above, the floor-slab structure body 1 according to the present embodiment is a concrete structure body improved in durability as a whole by improving durability of the connection portion 30.

6. Manufacturing Method (Construction Procedure) of Floor-Slab Structure Body

Figure 6:
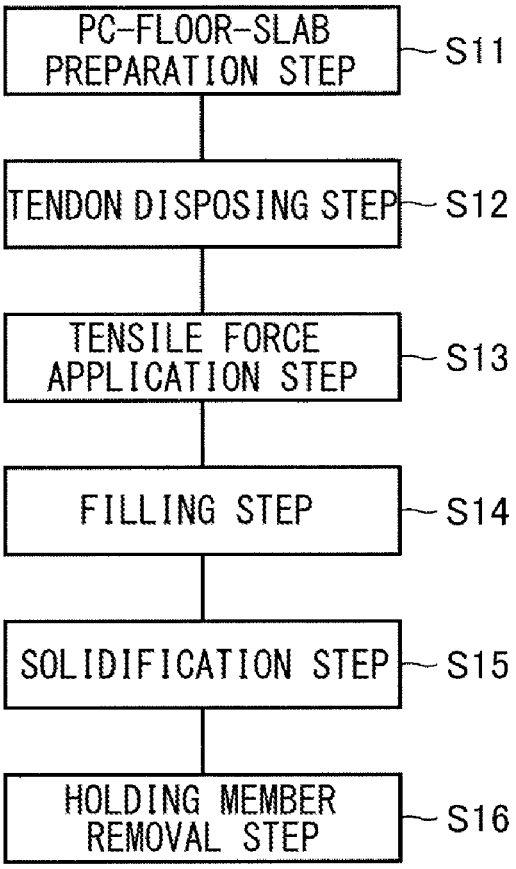
FIG. 6 is a flow chart illustrating an outline of a method of manufacturing the floor-slab structure body according to the first embodiment.
Figure 7:
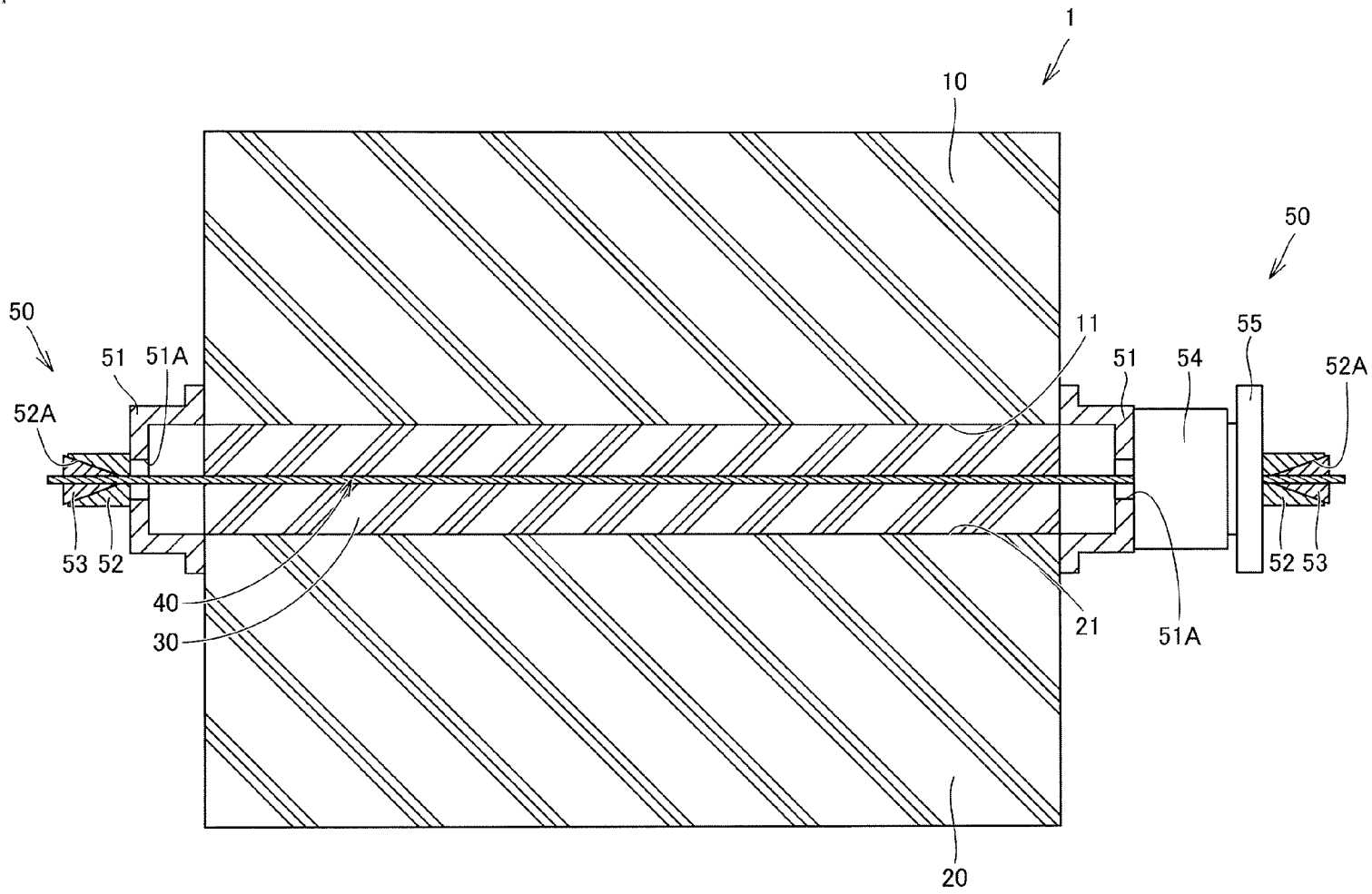
FIG. 7 is a schematic sectional view for describing the method of manufacturing the floor-slab structure body according to the first embodiment.

Next, an outline of the construction procedure of the floor-slab structure body 1 will be described with reference to FIG. 6 and FIG. 7. Referring to FIG. 6, in the construction of the floor-slab structure body 1 according to the present embodiment, a PC-floor-slab preparation step is first performed as a step (S11). Referring to FIG. 7, in the step (S11), the first floor slab 10 and the second floor slab 20 are prepared. The first floor slab 10 and the second floor slab 20 can be prepared by pouring uncured concrete (wet concrete) that has fluidity into a mold that has a predetermined shape and allowing the concrete to solidify. Then, the first floor slab 10 having the first facing surface 11 and the second floor slab 20 having the second facing surface 21 are disposed such that the first facing surface 11 and the second facing surface 21 face each other.

Next, a tendon disposing step is performed as a step (S12). In the step (S12), the tendon 40 is disposed, as illustrated in FIG. 7, so as to extend along the first facing surface 11 and the second facing surface 21 while the tendon 40 is held by a holding member 50 that is disposed to straddle on an external wall of the first floor slab 10 and on an external wall of the second floor slab 20. As the tendon 40, a tendon constituted by the twisted wire portion, described on the basis of FIG. 3, including the core wire 41 and the circumference wires 42, which are steel wires, may be employed, or a tendon that further includes the cover layer 43, described on the basis of FIG. 5, may be employed. The holding member 50 includes a base member 51, a grip member 52, a wedge member 53, a jack 54, and an anchor plate 55.

The tendon 40 is disposed to extend through a space between the first facing surface 11 and the second facing surface 21 and to have, at both sides, excess length portions that project from the space. The base member 51 is made of a material, such as metal, having high strength, for example, steel. A pair of the base members 51 are disposed. One of the base members 51 is disposed to straddle on the external wall of the first floor slab 10 and on the external wall of the second floor slab 20 on one side where the tendon 40 projects. The other of the base members 51 is disposed to straddle on the external wall of the first floor slab 10 and on the external wall of the second floor slab 20 on the other side where the tendon 40 projects. The base members 51 each include a through hole 51A.

On one of the base members 51, the grip member 52 and the wedge member 53 are mounted. The grip member 52 has, for example, a cylindrical shape and is made of metal, such as steel. The grip member 52 is disposed such that one end surface thereof is in contact with a surface of the base member 51 on a side opposite to the side facing the first floor slab 10 and the second floor slab 20. In the grip member 52, a conical recess 52A whose center axis coincides with the center axis of the grip member 52 is formed. The recess 52A has a tapered shape having a diameter that decreases toward the base member 51. The grip member 52 has a through hole that connects a pointed end of the recess 52A and an end surface on the side in contact with the base member 51 to each other.

The wedge member 53 has a conical shape corresponding to the recess 52A of the grip member 52 and is constituted by a plurality of members obtained by dividing a metal member in which a through hole is formed in a region that includes the center axis thereof in a circumferential direction along a plane including the center axis. The wedge member 53 is disposed by being fitted with respect to the grip member 52 so as to be in contact, at the outer circumferential surface, with an inner wall surface that surrounds the recess 52A of the grip member 52. The grip member 52 and the wedge member 53 are disposed such that respective center axes coincide with each other. In addition, the tendon 40 extends through the through holes 51A of the base members 51, the trough hole of the grip member 52, and the through hole of the wedge member 53.

On the other one of the base members 51, the jack 54, the anchor plate 55, the grip member 52, and the wedge member 53 are mounted by being stuck on each other in this order. As the jack 54, for example, a center-hole type jack is employable. The anchor plate 55 is made of, for example, steel and has a disc shape having a through hole at a center portion. The grip member 52 and the wedge member 53 have the same structures as the structures of those disposed on the one of the base members 51 and are mounted on a surface of the anchor plate 55 on a side opposite to the side facing the jack 54, in the same manner as with on the one of the base members 51. Note that, until a step (S13), which will be described later, is performed, the wedge member 53 on the side of the other one of the base members 51 is in a state of being detached from the grip member 52. The tendon 40 is disposed so as to extend through the through hole of the anchor plate 55 and the through hole of the grip member 52 after passing through an inner portion of the jack 54.

Next, a tensile force application step is performed as a step (S13). In this step (S13), a tensile force is applied to the tendon 40 by the jack 54. Specifically, the tendon 40 is pulled in the longitudinal direction by the jack 54. At this time, the wedge member 53 held by the grip member 52 on the base member 51 on the side opposite to the side where the jack 54 is mounted is pulled toward the base member 51. Consequently, the wedge member 53 fastens the tendon 40 in a radial direction and restricts the tendon 40. As a result, the tendon 40 enters a state of being elongated within a range of an elastic limit. Then, in this state, the wedge member 53 is pushed into a space between the tendon 40 and the grip member 52 on the base member 51 on the side where the jack 54 is mounted. Thereafter, when the tension applied to the tendon 40 by the jack 54 is released, the tendon 40 attempts to contract; however, the contraction is impeded by the restriction by the wedge member 53 and the grip member 52, and the tensile force is maintained.

Next, a filling step is performed as a step (S14). In the step (S14), a gap between the first facing surface 11 and the second facing surface 21 is filled with a filling material 30 that solidifies with a lapse of time. As the filling material 30, for example, uncured concrete (a mixture of cement, sand, gravel, and water) or uncured mortar (a mixture of cement, sand, and water) is employable. At this time, the holding member 50 is disposed so as to be spaced from the filling material 30. In other words, a gap is formed between the base members 51 and the filling material 30. Consequently, the base members 51 and the filling material 30 are suppressed from being joined together, and the filling material 30 is suppressed from adhering to base members 51, which facilitates reuse of the holding member 50 that includes the base members 51.

Next, a solidification step is performed as a step (S15). In the step (S15), the filling material 30 with which the gap between the first facing surface 11 and the second facing surface 21 is filled in the step (S14) cures with a lapse of time. The filling material 30 becomes the connection portion 30 as a result of curing.

Next, a holding-member removal step is performed as a step (S16). In the step (S16), the holding member 50 that holds the tendon 40 extending in the filling material 30 (connection portion 30) that has solidified in the step (S15) is removed. Specifically, the tendon 40 projecting from the connection portion 30 is cut and removed, and the holding member 50 is removed. Consequently, the method of manufacturing the floor-slab structure body 1 according to the present embodiment is completed.

In the method of manufacturing the floor-slab structure body 1 according to the present embodiment, the tendon 40 to which the tensile force is applied in the longitudinal direction is disposed in the filling material 30 that has solidified. Consequently, a compressive stress is applied to the connection portion 30 obtained as a result of the filling material 30 solidifying. As a result, the floor-slab structure body 1 improved in durability as a whole by improving durability of the connection portion 30 is easily manufactured. In addition, in the present embodiment, the gap between the first facing surface 11 and the second facing surface 21 is filled with the filling material 30 in a state in which the tendon 40 is tensed in advance, and the filling material 30 is allowed to solidify. In other words, the compressive stress is applied to the connection portion 30 by a pre-tensioning method. Consequently, quick application of the compressive stress to the connection portion 30 and at low costs is enabled. Moreover, in the present embodiment, the holding member 50 is disposed to be spaced from the filling material 30. Consequently, reuse of the holding member 50 that includes the base members 51 is facilitated.

Figure 8:
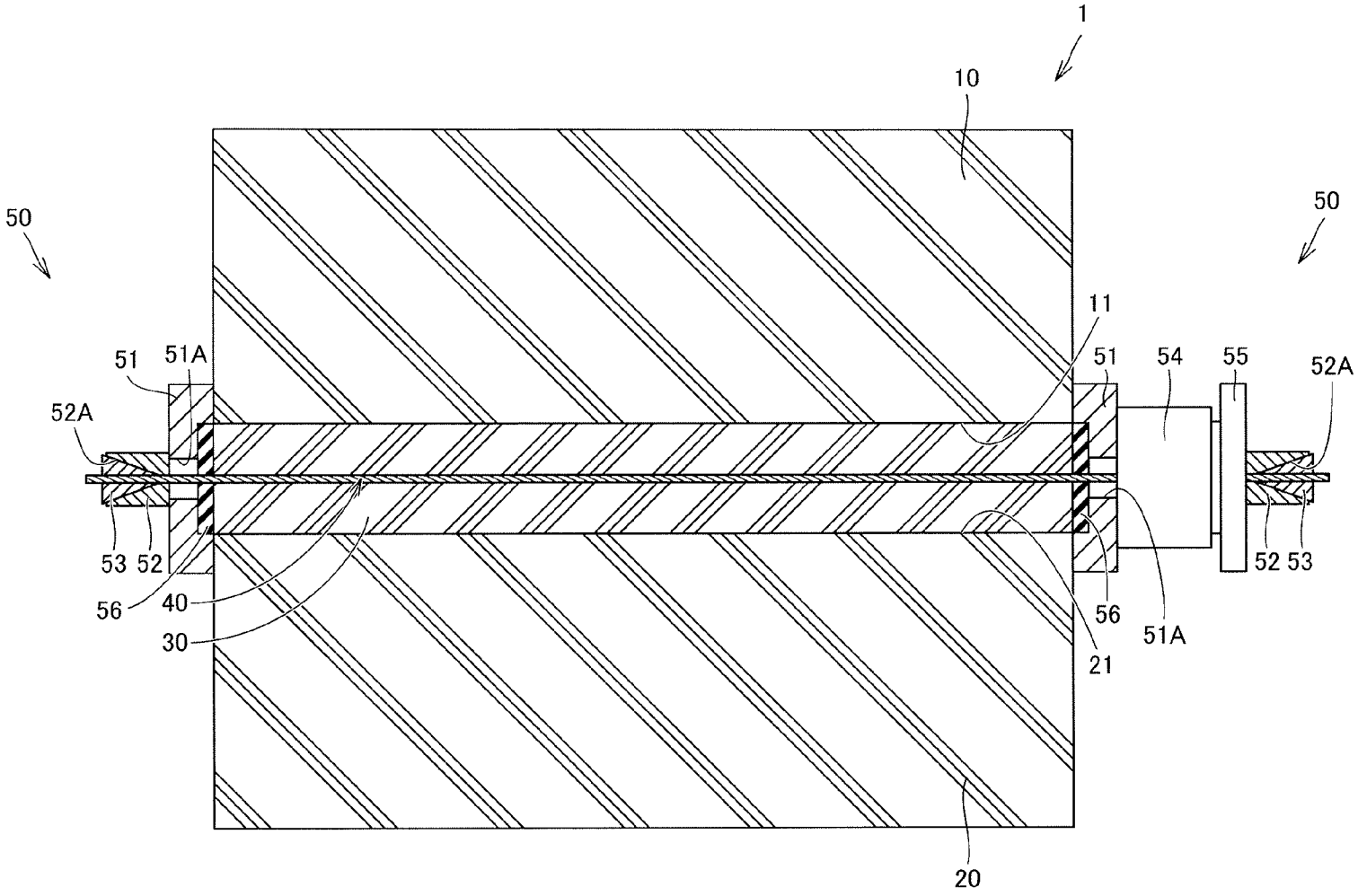
FIG. 8 is a schematic sectional view for describing a modification of the method of manufacturing the floor-slab structure body according to the first embodiment.

Note that, in the method of manufacturing the floor-slab structure body 1 according to the present embodiment, as illustrated in FIG. 8, an intermediate member 56 that impedes contact between the holding member 50 and the filling material 30 may be disposed between the holding member 50 (base members 51) and the filling material 30. As the intermediate member 56, for example, a wooden plate is employable. Consequently, the holding member 50 (base members 51) and the filling material 30 are suppressed from joining together, which further facilitates reuse of the holding member 50.

In addition, when the floor-slab structure body 1 of the modification described on the basis of FIG. 4 is to be manufactured, the first floor slab 10 and the second floor slab 20 including the first reinforcing steel 12 and the second reinforcing steel 22, respectively, of the modification are prepared in the step (S11), and a plurality of the tendons 40 are disposed between the first facing surface 11 and the second facing surface 21 in the step (S12). In the step (S13), a tensile force may be simultaneously applied to the plurality of tendons 40 in the longitudinal direction by the jack 54.

Second Embodiment

Next, a second embodiment, which is another embodiment, will be described. The floor-slab structure body 1 according to the second embodiment has basically the same structure and exerts the same effects as with the case of the first embodiment. The floor-slab structure body 1 according to the second embodiment, however, differs from the case of the first embodiment in terms of the tendon being inserted into a sheath and the tendon being held by an anchorage.

Figure 9:
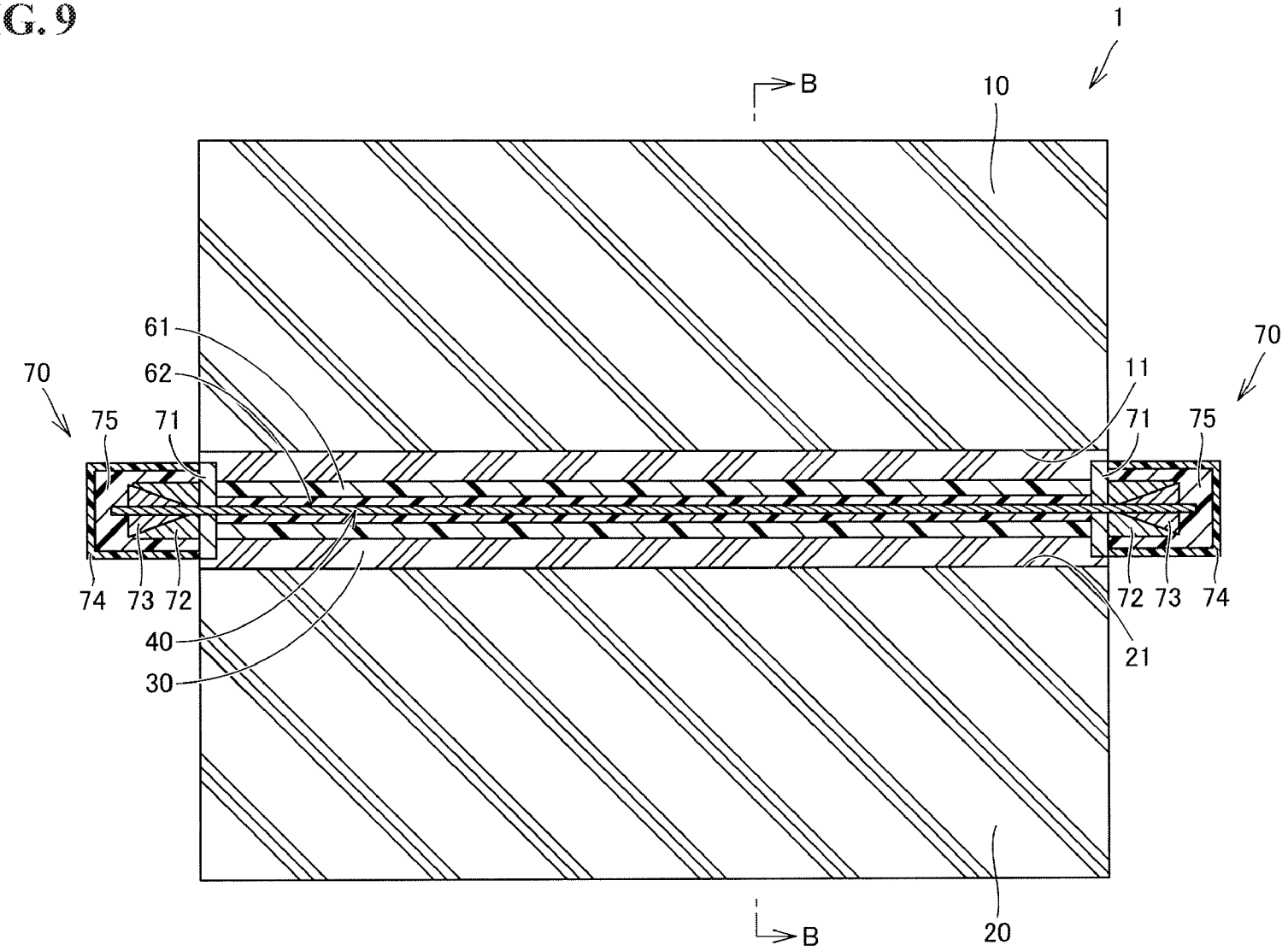
FIG. 9 is a schematic sectional view illustrating a structure of the floor-slab structure body according to a second embodiment.

FIG. 9 is a schematic sectional view illustrating a structure of the floor-slab structure body according to the second embodiment. In addition, FIG. 10 is a schematic sectional view illustrating a cross section of the floor-slab structure body at a face perpendicular to the longitudinal direction of the tendon.

Figure 10:
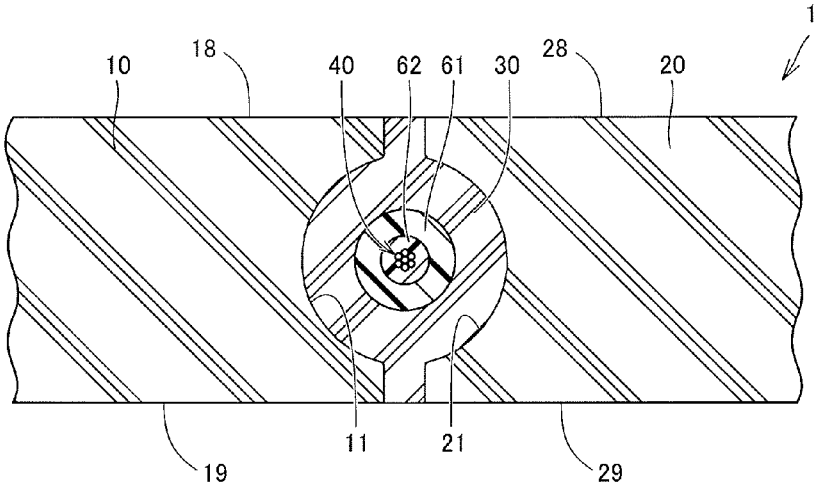
FIG. 10 is a schematic sectional view illustrating a cross section of the floor-slab structure body at a face perpendicular to the longitudinal direction of the tendon.

FIG. 10 is a partial sectional view along the line B-B of FIG. 9.

Referring to FIG. 9 and FIG. 10, the floor-slab structure body 1 according to the second embodiment further includes, in addition to the floor-slab structure body 1 of the first embodiment, a sheath 61 and an anchorage portion 70. The sheath 61 is disposed in the connection portion 30 along the first facing surface 11 and the second facing surface 21, more specifically, disposed to extend parallel to the first facing surface 11 and the second facing surface 21. The sheath 61 is disposed in a region at the center in the thickness direction of the first floor slab 10 and the second floor slab 20 and whose distance from the first facing surface 11 and distance from the second facing surface 21 are equal to each other. The sheath 61 extends through the connection portion 30. Both end surfaces of the sheath 61 are exposed from the connection portion 30. The sheath 61 has a tubular shape, more specifically, for example, a hollow cylindrical shape. The sheath 61 is made of, for example, a resin of polyethylene or the like.

The tendon 40 is inserted into the sheath 61 to extend through the entire length of the sheath 61, and a tensile force is applied to the tendon 40 in the longitudinal direction. A region between the sheath 61 and the tendon 40 is filled with a grout material 62. The tendon 40 is disposed to extend through the inside of the sheath 61 and to have, at both sides, excess length portions that project from both ends of the sheath 61.

The anchorage portion 70 anchors the excess length portions of the tendon 40 exposed from the sheath 61 to the connection portion 30. The anchorage portion 70 is disposed at each of both sides of the sheath 61. The anchorage portion 70 includes a support plate 71, a grip member 72, a wedge member 73, a cap 74, and a cover portion 75. In an extending direction of the tendon 40, a recess having, for example, a disc shape is formed in each of both end surfaces of the connection portion 30. In the recess, the support plate 71 that has a disc shape corresponding to the shape of the recess is fitted and mounted. In the support plate 71, a through hole extending through a center portion in the thickness direction is formed. The support plate 71 is made of metal, such as steel.

The grip member 72 and the wedge member 73 are disposed on a surface of the support plate 71 on a side opposite to the side in contact with the connection portion 30. The grip member 72 and the wedge member 73 have the same structures as those of the grip member 52 and the wedge member 53 employed in the aforementioned first embodiment. In other words, the anchorage portion 70 includes the wedge member 73 that restricts the tendon 40, and the grip member 72 that holds the wedge member 73. The cap 74 covers the grip member 72 and the wedge member 73, and the tendon 40 projecting from the wedge member 73. An inner portion of the cap 74 is filled with the cover portion 75. The cap 74 has a shape of a hollow cylinder whose one end portion is closed by a wall portion and the other end portion opens. The cap 74 is in contact, at the end portion on the open side, with the support plate 71, thereby covering the grip member 72 and the wedge member 73, and the tendon 40 projecting from the wedge member 73. The cap 74 and the cover portion 75 are made of, for example, a resin.

Even in such a structure, a compressive stress can be applied to the connection portion 30 of the floor-slab structure body 1. In addition, employing such a structure enables application of the compressive stress to the connection portion 30 by a post-tensioning method that applies a tensile force to the tendon 40 after the connection portion 30 is formed.

Figure 11:
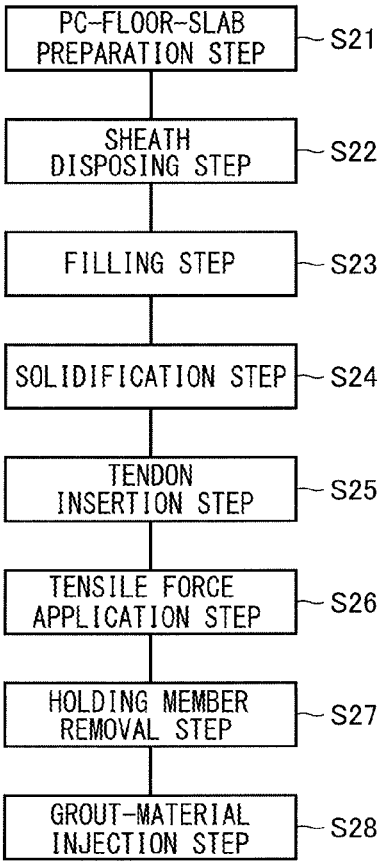
FIG. 11 is a flow chart illustrating an outline of a method of manufacturing the floor-slab structure body according to the second embodiment.
Figure 12:
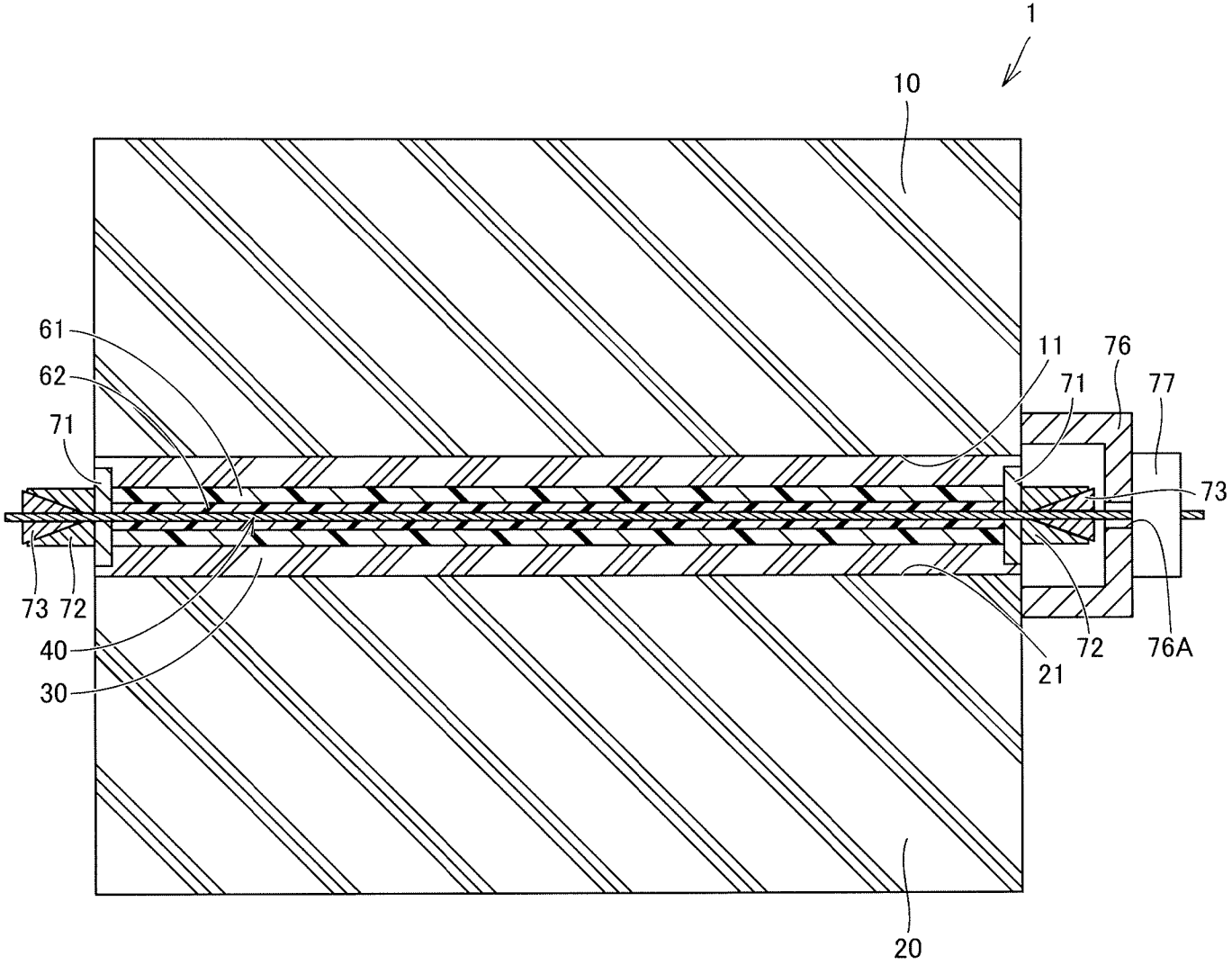
FIG. 12 is a schematic sectional view for describing the method of manufacturing the floor-slab structure body according to the second embodiment.

Next, an outline of the construction procedure of the floor-slab structure body 1 according to the second embodiment will be described with reference to FIG. 11 and FIG. 12. Referring to FIG. 11, in the construction of the floor-slab structure body 1 according to the present embodiment, first, the PC-floor-slab preparation step is performed as a step (S21). The step (S21) can be performed in the same manner as with the step (S11) of the first embodiment.

Next, a sheath disposing step is performed as a step (S22). Referring to FIG. 12, in the step (S22), the sheath 61 is disposed so as to extend along the first facing surface 11 and the second facing surface 21. Next, the filling step and the solidification step are performed as steps (S23) and (S24). The steps (S23) and (S24) are performed in the same manner as with the steps (S14) and (S15) of the first embodiment in a state in which the sheath 61 is disposed. The filling material 30 becomes the connection portion 30 by solidifying. Next, a tendon insertion step is performed as a step (S25). In the step (S25), the tendon 40 is inserted so as to extend through the entire length of the sheath 61 such that the excess length portions project from both ends of the sheath 61.

Next, the tensile force application step is performed as a step (S26). In the step (S26), a tensile force is applied to the tendon 40 that is inserted into the sheath 61 in the step (S25). Specifically, referring to FIG. 12, the support plate 71 and the grip member 72 are disposed at portions of the connection portion 30 formed as a result of the filling material 30 solidifying, the portions corresponding to both ends of the sheath 61. The tendon 40 extends through the support plate 71 and the grip member 72. Then, the wedge member 73 is pushed into a space between the tendon 40 and the grip member 72 disposed on one end portion side of the sheath 61.

On the other end portion side of the sheath 61, a base member 76 made of, for example, steel is disposed. The base member 76 is disposed to straddle on the external wall of the first floor slab 10 and on the external wall of the second floor slab 20. The base member 76 is disposed to straddle the grip member 72. In the base member 76, a through hole 76A is formed. On a surface of the base member 76 on a side opposite to the side facing the connection portion 30, a jack 77 is disposed. The tendon 40 passes through the through hole 76A of the base member 76 and goes into the jack 77. The jack 77 holds the tendon 40. The base member 76 and the jack 77 constitute a holding member.

Then, a tensile force is applied to the tendon 40 by the jack 77. Specifically, the tendon 40 is pulled in the longitudinal direction by the jack 77. At this time, the wedge member 73 held by the grip member 72 on the support plate 71 on a side opposite to the side where the jack 77 is mounted is pulled toward the support plate 71. Consequently, the wedge member 73 fastens the tendon 40 in the radial direction and restricts the tendon 40. As a result, the tendon 40 enters a state of being elongated within a range of an elastic limit. Then, in this state, the wedge member 73 is pushed into a space between the tendon 40 and the grip member 72 on the support plate 71 on the side where the jack 77 is mounted. Thereafter, when the tension applied to the tendon 40 by the jack 77 is released, the tendon 40 attempts to contract; however, the contraction is impeded due to the restriction by the wedge member 73 and the grip member 72, and the tensile force is maintained.

Next, the holding-member removal step is performed as a step (S27). In the step (S27), the jack 77 in the state of releasing application of the tensile force with respect to the tendon 40 and the base member 76 that supports the jack 77 are detached. Next, a grout-material injection step is performed as a step (S28). In the step (S28), the grout material 62 is injected into a space between the sheath 61 and the tendon 40 to which the tensile force is applied. The grout material 62 is made of a resin that cures with a lapse of time. The curing of the grout material 62 causes the tendon 40 and the connection portion 30 to be integrated. Thereafter, an excess portion of the tendon 40 projecting from the wedge member 73 is cut and removed. Then, with the cap 74 mounted to cover the grip member 72 and the wedge member 73, and the tendon 40 projecting from the wedge member 73, the inside of the cap 74 is filled with the cover portion 75. Consequently, the method of manufacturing the floor-slab structure body 1 according to the present embodiment is completed.

In the method of manufacturing the floor-slab structure body 1 according to the present embodiment, the tendon 40 to which a tensile force is applied in the longitudinal direction is disposed in the filling material 30 that has solidified. Consequently, a compressive stress is applied to the connection portion 30 obtained as a result of the filling material 30 solidifying. As a result, the floor-slab structure body 1 improved in durability as a whole by improving durability of the connection portion 30 can be easily manufactured. In addition, in the present embodiment, the tendon 40 is tensed after the connection portion 30 is formed, and the compressive stress is applied to the connection portion 30. In other words, in the present embodiment, the compressive stress is applied to the connection portion 30 by the post-tensioning method.

Note that the extending direction of the tendon 40 may be a direction along a bridge axis direction (travelling direction of vehicles and the like) and may be a direction (for example, a direction perpendicular to the bridge axis direction) intersecting the bridge axis direction.

The embodiments disclosed here are presented as examples in all respects and should be understood as non-restrictive in any aspects. The scope of the present invention is prescribed by the claims not by the aforementioned description and intends to include meanings equivalent to the claims, and all changes within the scope.

REFERENCE SIGNS LIST

1 floor-slab structure body
10 first floor slab
11 first facing surface
12 first reinforcing steel
18 first-floor-slab first face
19 first-floor-slab second face
20 second floor slab
21 second facing surface
22 second reinforcing steel
28 second-floor-slab first face
29 second-floor-slab second face
30 connection portion (filling material)
40 tendon
41 core wire
42 circumference wire
43 cover layer
50 holding member
51 base member
51*a* through hole
52 grip member
52*a* recess
53 wedge member
54 jack
55 anchor plate
56 intermediate member
61 sheath
62 grout material
70 anchorage portion
71 support plate
72 grip member
73 wedge member
74 cap
75 cover portion
76 base member
76*a* through hole
77 jack

The invention claimed is:

1. A concrete structure body comprising:

a first concrete member having a first reinforcing steel and a first facing surface;

a second concrete member having a second reinforcing steel and a second facing surface and disposed such that the first facing surface and the second facing surface face each other;

a connection portion that fills a gap between the first facing surface and the second facing surface; and a plurality of tendons disposed in the connection portion to extend along the first facing surface and the second facing surface and to which a tensile force is applied in a longitudinal direction, wherein:

the first reinforcing steel and the second reinforcing steel are disposed such that first portions thereof are embedded in the first concrete member and the second concrete member, respectively, and loop portions, which are second portions thereof, project from the first facing surface and the second facing surface, respectively, the first reinforcing steel projects toward the second facing surface and the second reinforcing steel projects toward the first facing surface, in the longitudinal direction of the plurality of tendons, the first reinforcing steel and the second reinforcing steel project, at positions that differ from each other, from the first facing surface and the second facing surface, respectively, the first reinforcing steel and the second reinforcing steel are disposed such that, in plan view in a direction along the longitudinal direction of the plurality of tendons, the first reinforcing steel and the second reinforcing steel that respectively project from the first facing surface and the second facing surface overlap each other, end portions of the first facing surface and the second facing surface on a side of a first concrete member second face and a second concrete member second face project, compared with the side of the first concrete member second face and the second concrete member second face, a distance between the first facing surface and the second facing surface is larger on a side of a first concrete member first face and a second concrete member first face, in a region in which the distance between the first facing surface and the second facing surface is larger, the first reinforcing steel and the second reinforcing steel project from the first facing surface and the second facing surface, respectively, the plurality of tendons includes three tendons in the connection portion, and among the three tendons, two tendons extend through an inside the loop portions of the first reinforcing steel and the second reinforcing steel, and one tendon extends through an outside of the loop portions of the first reinforcing steel and the second reinforcing steel.

2. The concrete structure body according to claim 1, wherein the plurality of tendons compress the connection portion with an adhesion force with respect to the connection portion.

3. The concrete structure body according to claim 1, wherein the plurality of tendons each include a twisted wire portion having a structure constituted by a plurality of steel wires that are twisted together, the twisted wire portion extending in the connection portion along the first facing surface and the second facing surface.

4. The concrete structure body according to claim 1, wherein the plurality of tendons each include a cover layer that covers an outer circumference of a respective tendon of the plurality of tendons.

5. The concrete structure body according to claim 1, wherein the connection portion is made of concrete or mortar.

6. A method of manufacturing a concrete structure body, comprising:

a step of disposing a first concrete member having a first reinforcing steel and a first facing surface and a second concrete member having a second reinforcing steel and a second facing surface such that the first facing surface and the second facing surface face each other;

a step of disposing a plurality of tendons so as to extend along the first facing surface and the second facing surface and, while holding the plurality of tendons with a holding member disposed to straddle on an external wall of the first concrete member and on an external wall of the second concrete member, simultaneously applying a tensile force to the plurality of tendons in a longitudinal direction of the plurality of tendons;

a step of filling a gap between the first facing surface and the second facing surface with a filling material that solidifies with a lapse of time; and a step of removing the holding member that holds the plurality of tendons extending in the filling material that has solidified, wherein:

the first reinforcing steel and the second reinforcing steel are disposed such that first portions thereof are embedded in the first concrete member and the second concrete member, respectively, and loop portions, which are second portions thereof, project from the first facing surface and the second facing surface, respectively, the first reinforcing steel projects toward the second facing surface and the second reinforcing steel projects toward the first facing surface, in the longitudinal direction of the plurality of tendons, the first reinforcing steel and the second reinforcing steel project, at positions that differ from each other, from the first facing surface and the second facing surface, respectively, the first reinforcing steel and the second reinforcing steel are disposed such that, in plan view in a direction along the longitudinal direction of the plurality of tendons, the first reinforcing steel and the second reinforcing steel that respectively project from the first facing surface and the second facing surface overlap each other, end portions of the first facing surface and the second facing surface on a side of a first concrete member second face and a second concrete member second face project, compared with the side of the first concrete member second face and the second concrete member second face, a distance between the first facing surface and the second facing surface is larger on a side of a first concrete member first face and a second concrete member first face, in a region in which the distance between the first facing surface and the second facing surface is larger, the first reinforcing steel and the second reinforcing steel project from the first facing surface and the second facing surface, respectively, the plurality of tendons includes three tendons in the filling material, and among the three tendons, two tendons extend through an inside the loop portions of the first reinforcing steel and the second reinforcing steel, and one tendon extends through an outside of the loop portions of the first reinforcing steel and the second reinforcing steel.

7. The method of manufacturing the concrete structure body according to claim 6, wherein, after the step of applying the tensile force to the plurality of tendons in the longitudinal direction of the plurality of tendons, the step of filling the gap between the first facing surface and the second facing surface with the filling material is performed.

8. The method of manufacturing the concrete structure body according to claim 6, wherein the plurality of tendons each include a twisted wire portion constituted by a plurality of steel wires that are twisted together.

9. The method of manufacturing the concrete structure body according to claim 6, wherein the plurality of tendons each include a cover layer that covers an outer circumference of the plurality of tendons.

10. The method of manufacturing the concrete structure body according to claim 6, wherein the holding member is disposed to be spaced from the filling material.

11. The method of manufacturing the concrete structure body according to claim 10, wherein, between the holding member and the filling material, an intermediate member that impedes contact between the holding member and the filling material is disposed.

12. The method of manufacturing the concrete structure body according to claim 6, wherein the holding member includes a wedge member that restricts the tendon, and a grip member that holds the wedge member.

13. The method of manufacturing the concrete structure body according to claim 6, wherein the filling material is uncured concrete or uncured mortar.

* * * * *